US009823605B2

(12) United States Patent
Kauffmann-Guerrero et al.

(10) Patent No.: US 9,823,605 B2
(45) Date of Patent: Nov. 21, 2017

(54) METHOD AND APPARATUS TO IMPROVE TONER TRANSFER IN A PRINTER

(71) Applicant: Oce Printing Systems GmbH & Co. KG, Poing (DE)

(72) Inventors: Sabine Kauffmann-Guerrero, Munich (DE); Thomas Montag, Unterhaching (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/172,532

(22) Filed: Jun. 3, 2016

(65) Prior Publication Data

US 2016/0357131 A1 Dec. 8, 2016

(30) Foreign Application Priority Data

Jun. 3, 2015 (DE) ..... 10 2015 108 776

(51) Int. Cl.
*G03G 15/16* (2006.01)

(52) U.S. Cl.
CPC ..... *G03G 15/1665* (2013.01); *G03G 15/168* (2013.01)

(58) Field of Classification Search
CPC ..... G03G 15/1665; G03G 15/168
See application file for complete search history.

(56) References Cited

U.S. PATENT DOCUMENTS 6,144,836 A * 11/2000 Umeda ..... G03G 15/657 399/306
6,395,387 B1 5/2002 Mochizuki
9,268,286 B2 2/2016 Bayer et al.
2008/0260438 A1* 10/2008 Uda ..... G03G 15/0194 399/346
2009/0060611 A1* 3/2009 Minbu ..... G03G 15/754 399/397
2009/0080956 A1 3/2009 Montfort et al.
2014/0101959 A1* 4/2014 Priebe ..... F26B 3/22 34/60

(Continued)

FOREIGN PATENT DOCUMENTS

DE 102013201549 B3 6/2014
JP H01233462 A 9/1989

(Continued)

*Primary Examiner* — Rodney Bonnette
(74) *Attorney, Agent, or Firm* — Schiff Hardin LLP

(57) ABSTRACT

A print group for a digital printer can include a transfer station and a wetting system. The transfer station can be configured to transfer a toner image onto a first side of a recording medium at a transfer point in response to an electrical field, the transfer station being configured to apply the electrical field between a transfer electrode on the first side of the recording medium and a counter-electrode on a second side of the recording medium, wherein the recording medium is directed between the transfer electrode and the counter-electrode. The wetting system can be configure to apply a conductive fluid onto a surface of the second side of the recording medium at the transfer point, the conductive fluid at least partially forming a conductive connecting layer between the surface of the second side of the recording medium and a surface of the counter-electrode at the transfer point.

19 Claims, 5 Drawing Sheets

(56) References Cited

U.S. PATENT DOCUMENTS

| | | | | |
|---|---|---|---|---|
| 2014/0212632 | A1 | 7/2014 | Bayer et al. | |
| 2016/0154346 | A1* | 6/2016 | Fromm | G03G 15/1605 399/310 |

FOREIGN PATENT DOCUMENTS

| | | | |
|---|---|---|---|
| JP | 2004054163 | A | 2/2004 |
| JP | 2014149526 | | 8/2014 |

* cited by examiner

METHOD AND APPARATUS TO IMPROVE TONER TRANSFER IN A PRINTER

CROSS REFERENCE TO RELATED APPLICATIONS

This patent application claims priority to German Patent Application No. 102015108776.6, filed Jun. 3, 2015, which is incorporated herein by reference in its entirety.

BACKGROUND

The disclosure is directed to an electrophotographic digital printer for printing to a recording medium with toner particles and a corresponding method.

Given electrophotographic digital printers, a latent charge image of an image carrier is inked with toner (for example liquid toner or dry toner). The toner image that is created in such a manner is typically transferred indirectly to a recording medium via a transfer station. In this transfer step, an electric field is used in order to print the toner image onto the recording medium.

Cardboard (e.g., for the manufacture of a folding cardboard box) may be used as a recording medium, for example. Cardboard is most often finished only on the top side or front side, for example via repeated coating processing, wherein the back side is typically coated only once or not at all. The back side of cardboard thus most often has a rough or uneven surface. Furthermore, cardboard typically has a substantial thickness (of up to 500 for example).

Such recording media with an inhomogeneous back side may interfere with the transfer step (assisted by an electric field) of a toner image onto the top side of the recording medium. In particular, the print quality of a print image on the top side of the recording medium may be reduced due to an inhomogeneous back side. Furthermore, the transfer step may be negatively affected by the thickness of the cardboard.

U.S. Pat. No. 6,395,387B1 describes a two-sided, coated, transparent recording medium for an electrophotographic printer. JP2004-054163A describes a printer with means to adjust the moisture of a recording medium. US2009/0080956A1 describes a printer in which a conductive film is applied onto the surface of a recording medium. JP H01-233462A describes a printer in which a fluid is applied onto the surface of an electrostatic recording medium.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to increase the print quality of an electrophotographic digital printer upon printing to a recording medium with a rough back side and/or with a relatively large thickness.

According to one aspect, a print group for a digital printer is described. The print group comprises a transfer station that is set up to transfer a toner image onto a first side of a recording medium at a transfer point under the effect of an electric field. The transfer station is thereby set up to apply the electric field between a transfer electrode at the first side of the recording medium and a counter-electrode at a second side of the recording medium. Furthermore, the print group comprises wetting means that are set up to apply a conductive fluid onto the surface of the second side of the recording medium so that, at the transfer point, the conductive fluid at least partially forms a conductive connecting layer between the surface of the second side of the recording medium and a surface of the counter-electrode.

According to a further aspect, a method is described for improving the transfer of a toner image onto a first side of a recording medium in a digital printer. The digital printer comprises a transfer electrode and a counter-electrode between which the recording medium is directed in order to transfer the toner image onto the first side of the recording medium at a transfer point. The method includes the application of a conductive fluid onto a surface of a second side of the recording medium. The conductive fluid is applied so that, at the transfer point, the conductive fluid at least partially forms a conductive connecting layer between the surface of the second side of the recording medium and a surface of the counter-electrode. Moreover, the method includes the application of an electric field between the transfer electrode and the counter-electrode at the transfer point in order to produce and/or assist in the transfer of the toner image onto the first side of the recording medium.

Figure 1:
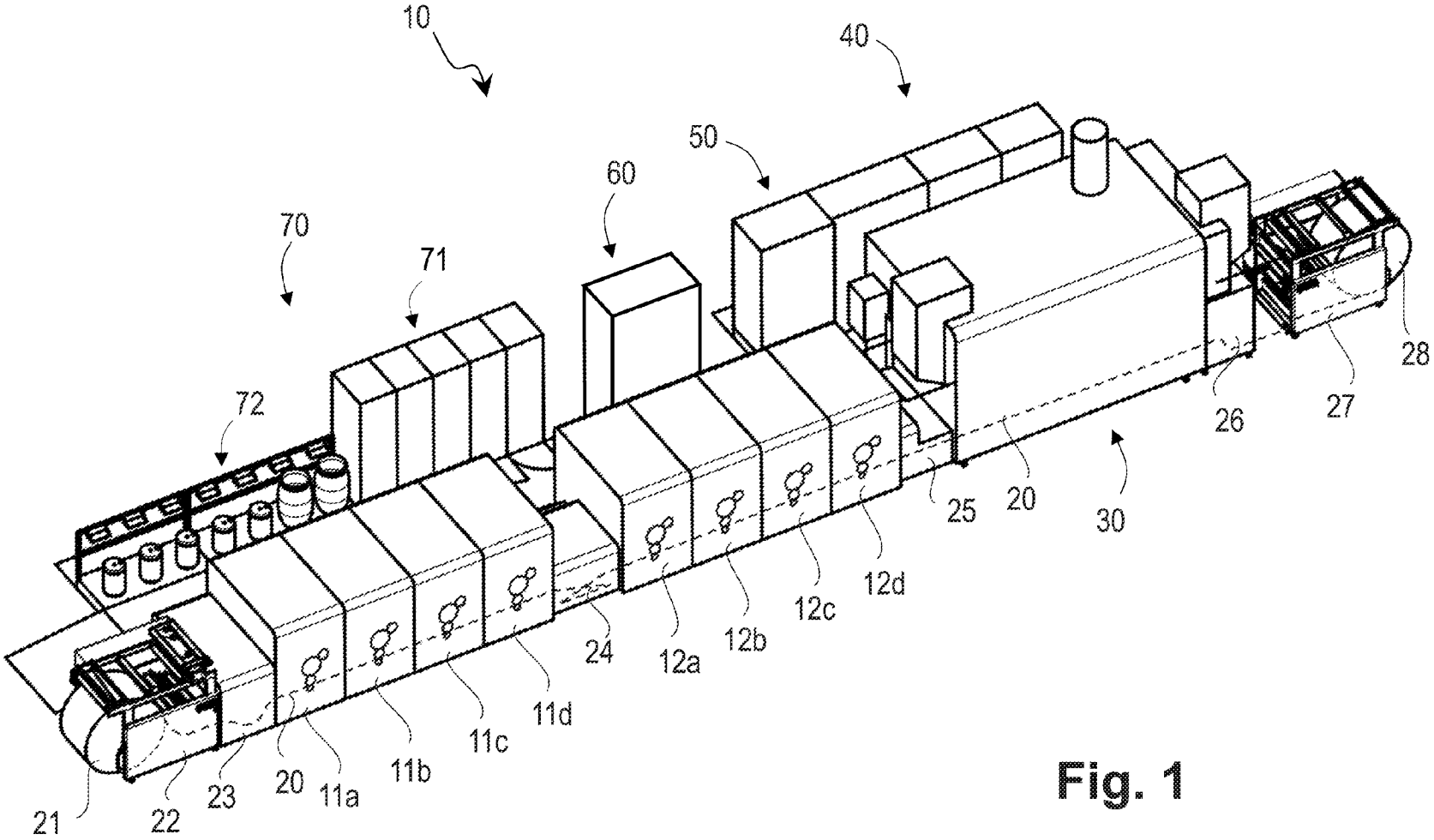
FIG. 1 shows a digital printer according to an exemplary embodiment of the present disclosure.

FIG. 1 illustrates a digital printer 10 according to an exemplary embodiment of the present disclosure. The digital printer 10 can be configured to print to a recording medium 20, and can include one or more print groups 11*a*-11*d* and 12*a*-12*d* that print a toner image (print image 20'; see FIG. 2) onto the recording medium 20. As shown, a web-shaped recording medium 20 (as a recording medium 20) is unrolled from a roll 21 with the aid of a take-off 22 and is supplied to the first print group 11*a*. The print image 20' is fixed on the recording medium 20 in a fixer 30. The recording medium 20 may subsequently be taken up on a roll 28 with the aid of a take-up 27. Such a configuration is also designated as a roll-to-roll printer. Details regarding the digital printer 10 of FIG. 1 are described in detail in German Patent document DE 10 2013 201 549 B3 as well as in the corresponding Japanese Patent Application publication JP 2014/149526 A and the corresponding United States Patent Application publication US 2014/0212632 A1. Each of these documents is incorporated herein by reference in its entirety.

Figure 2:
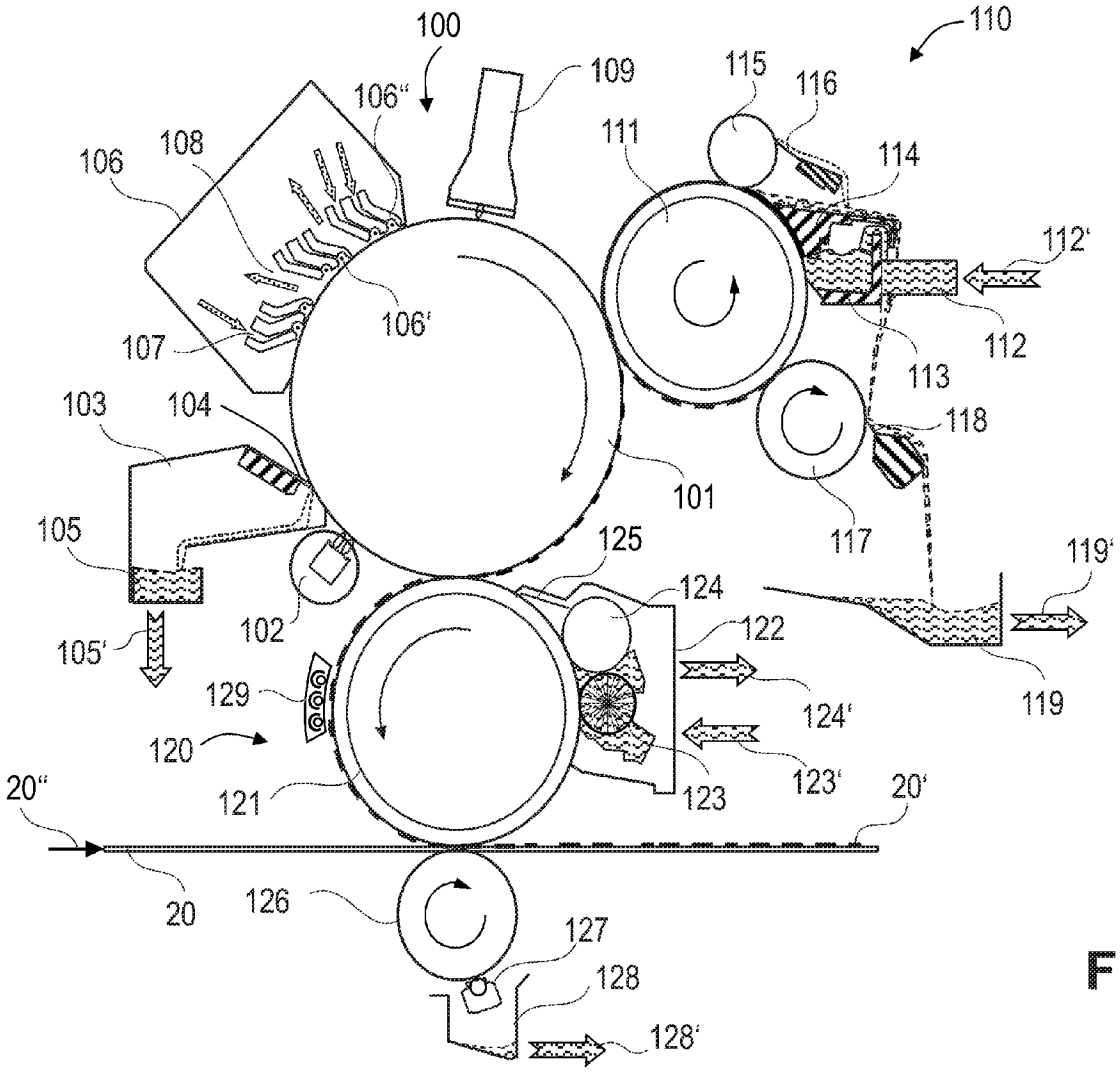
FIG. 2 shows a print group of the digital printer according to FIG. 1.

FIG. 2 illustrates a print group according to an exemplary embodiment of the present disclosure. The print group illustrated in FIG. 2 can be an example of the print group 11, 12 shown in FIG. 1. In an exemplary embodiment, the print group depicted in FIG. 2 is based on the electrophotographic principle, given which a photoelectric image carrier (in particular a photoconductor 101) is inked with the aid of a liquid developer with charged toner particles, and the toner image that is created in such a manner is transferred to the recording medium 20. The print group 11, 12 can include an electrophotography station 100, a developer station 110 and a transfer station 120.

The electrophotography station 100 can include a photoelectric image carrier that has a photoelectric layer (what is known as a photoconductor) on its surface. The photoconductor can be designed as a roller (photoconductor roller 101) that has a hard surface. The photoconductor roller 101 rotates past the various elements to generate a print image 20' (rotation in the arrow direction).

In an exemplary embodiment, the electrophotography station 100 can include a character generator 109 that generates a latent image on the photoconductor 101. The latent image is inked with toner particles by the developer station 110 in order to generate an inked image. For this, the developer station 110 has a rotating developer roller 111 that brings a layer of liquid developer onto the photoconductor 101.

The inked image rotates with the photoconductor roller 111 up to a first transfer point, at which the inked image is essentially completely transferred onto a transfer roller 121. The recording medium 20 travels in the transport direction 20" between the transfer roller 121 and a counter-pressure roller 126. The contact region (nip) represents a second transfer point in which the toner image is transferred onto the recording medium 20. The recording medium 20 may be made of paper, paperboard, cardboard, metal, plastic and/or other suitable and printable materials. Details of the print group illustrated in FIG. 2 are described in German Patent document DE 10 2013 201 549 B3 as well as in the corresponding Japanese Patent Application publication JP 2014/149526 A and the corresponding United States Patent Application publication US 2014/0212632 A1.

An aspect of the present disclosure is to increase the print quality of an electrophotographic digital printer 10 given recording media 20 that have a back side with a rough surface and/or that have a relatively large thickness (for example of 200 μm or more). Cardboard for the manufacturing of a box is an exemplary of a recording medium 20 that can have such properties.

In an electrophotographic printing process, the transfer roller 121, the recording medium 20, the counter-pressure roller 126 and if applicable the developer fluid represent an electrical resistance chain. The field strength of the electrical field at the nip of the transfer roller 121, and therefore the quality of the toner transfer to the top side of the recording medium 20, can depend on the resistance values of the electrical resistances of this resistance chain. For example, the electrical resistance between the recording medium 20 and the counter-pressure roller 126 may be increased in that no direct contact exists between the back side of the recording medium 20 and the surface of the counter-pressure roller 126. However, for a qualitatively high-grade toner transfer, the counter-pressure roller 126 and the back side of the recording medium 20 can be situated atop the other so that the contact resistance between the counter-pressure roller 126 and the back side of the recording medium 20 is as low as possible.

An increased contact resistance on the back side of the recording medium 20 may lead to a reduction of the electrical field at the nip of the transfer roller 121, and therefore to a reduction of the toner transfer rate. The use of a recording medium 20 with a rough surface on the back side of said recording medium 20, and the use of a counter-pressure roller 126 with a hard surface, may lead to the situation where unevenness of the back side of the recording medium 20 may not be sufficiently leveled, and thus an inhomogeneous contact resistance is created over the surface of the recording medium 20. The inhomogeneous contact resistance may then lead to an inhomogeneous print quality of the print image 20' transferred onto the front side or back side of the recording medium 20. The side of the recording medium 20 that is to be printed to is also designated as the first side in this document. On the other hand, the other, opposite side of the recording medium 20 (for example the back side or underside) is designated as the second side.

Furthermore, typical recording media 20 with differing width (transversal to a transport direction 20" of the recording medium 20 (along the axial direction of, for example, the counter-pressure roller 126)) may be printed to by a digital printer 10. Depending on the width of the recording medium 20, the substrate-free nip at the transfer roller 121 (at which the surface of the transfer roller 121 is in direct contact with the surface of the counter-pressure roller 126) is of different width. Parasitic currents may flow across this substrate-free nip. In addition to this, the substrate-free nip is of lower electrical resistance in the resistance chain than the substrate nip given which the recording medium 20 is located between the transfer roller 121 and the counter-pressure roller 126. Accordingly, a greater current typically flows in the substrate-free nip than in the substrate nip. In particular given relatively thick recording media 20, this may lead to the situation that the current flow in the substrate nip is too low for an optimal toner transfer. This situation may be compensated via an increase of the voltage between transfer roller 121 and counter-pressure roller 126 (and therefore via an increase of the current) only to a certain degree since it may lead to avalanche breakdowns, depending on properties of the recording medium 20 (for example moisture of the recording medium 20) and properties of the environment of the digital printer (for example humidity). A regulation of the current flow in the substrate nip for an optimally homogeneous and complete toner transfer is thus made more difficult.

Therefore, it is advantageous to reduce and/or to homogenize the contact resistance between the back side of the recording medium 20 and the counter-pressure roller 126 in order to increase the print quality of a print image on the top side of the recording medium 20.

In an exemplary embodiment, the contact pressure force between transfer roller 121 and counter-pressure roller 126 can be increased to reduce and/or to homogenize the contact resistance. In this example, unevenness on the back side of the recording medium 20 may thus be reduced.

Figure 3:
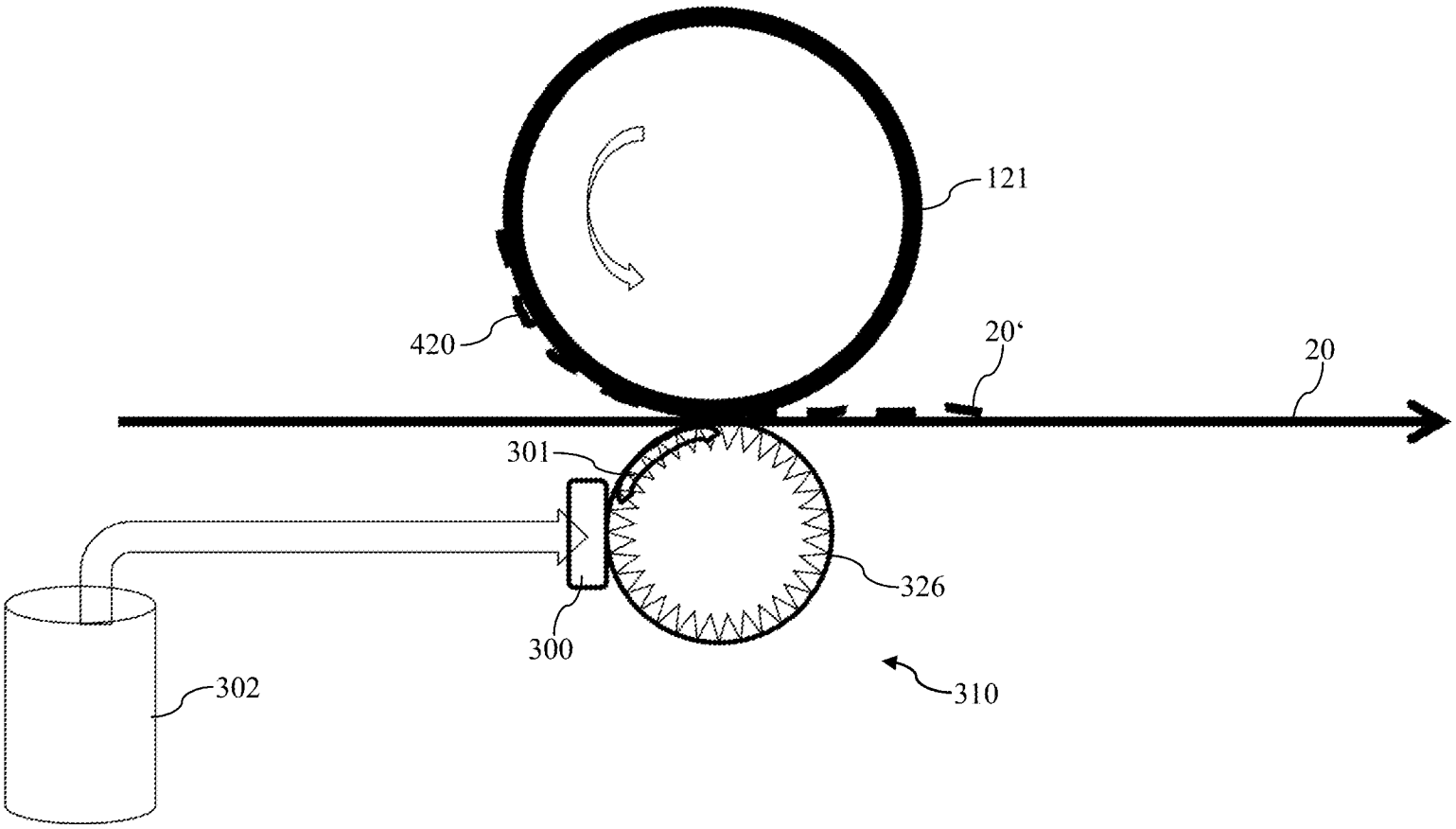
FIG. 3 shows an elevational view of a wetting system along the axial direction of a counter-pressure roller of the print group according to an exemplary embodiment of the present disclosure.

FIG. 3 illustrates a wetting system 310 according to an exemplary embodiment of the present disclosure. The wetting system 310 can be configured to reduce and/or homogenized the contact resistance between the back side of a recording medium 20 and the counter-pressure roller 326. In an exemplary embodiment, the wetting system 310 can be configured to apply a conductive fluid 301 onto the surface of the back side of the recording medium 20. In an exemplary embodiment, the application of the conductive fluid 301 can take place before or at the transfer point. In this example, the configuration can prevent and/or diminish the conductive fluid 301 from penetrating below the surface of the recording medium 20 before reaching the transfer point. In an exemplary embodiment, the application of the conductive fluid 301 occurs before or at a point on the back side (i.e. the second side) of the recording medium 20 that corresponds to the transfer point on the front side (i.e. the first side) of the recording medium 20. For the purpose of this discussion, this point on the back side of the recording medium 20 is likewise designated as a transfer point.

In an exemplary embodiment, the conductive fluid 301 may comprise water. Furthermore, the conductive fluid 301 may comprise additives that increase the conductivity of the fluid 301 (in comparison to the conductivity of water).

In an exemplary embodiment, the wetting system 310 includes a counter-pressure roller 326 that is configured as a raster roller (e.g., screen roller, anilox roller). The counter-pressure roller 326 can be configured to transport the conductive fluid 301 onto the surface of the back side of the recording medium 20 using the raster cups of the raster roller. In an exemplary embodiment, the wetting system 310 includes a wetting device 300. The wetting device 330 can be configured as a chamber blade and that configured to wet the counter-pressure roller 326 with the conductive fluid 301. As shown in FIG. 3, the conductive fluid 301 is transferred from the wetting device 300 to the counter-pressure roller 326 and from the counter-pressure roller 326 onto the surface of the back side of the recording medium 20. The wetting device 300 can be configured to extract the conductive fluid 301 from a container 302 via a supply line.

In an exemplary embodiment, during the printing process, a conductive fluid 301 is applied by the counter-pressure roller 326 onto the surface of the back side of the recording medium 20. In an exemplary embodiment, the conductive fluid 301 is a fluid film with a conductive fluid (water, for example). The fluid film may be applied onto the surface of the back side of the recording medium 20. The fluid film forms a conductive connecting layer between the recording medium 20 and the counter-pressure roller 326 and provides for a uniformly good contacting between the counter-pressure roller 326 and the recording medium 20, and therefore for a homogenization of the contact resistance. Furthermore, the contact resistance and the electrical resistance of the recording medium 20 are reduced by the fluid film. Both effects have a positive effect on the toner transfer onto the top side of the recording medium 20.

In an exemplary embodiment, the wetting device 300 (such as a chamber blade, for example) may be configured to have different widths compared to the recording medium 20 and/or of the toner image 420. For example, the wetting device 300 can be configured to wet only the portion of the counter-pressure roller 326 that is in contact with the recording medium 20 and/or that corresponds to the width of the toner image 420.

Figure 4:
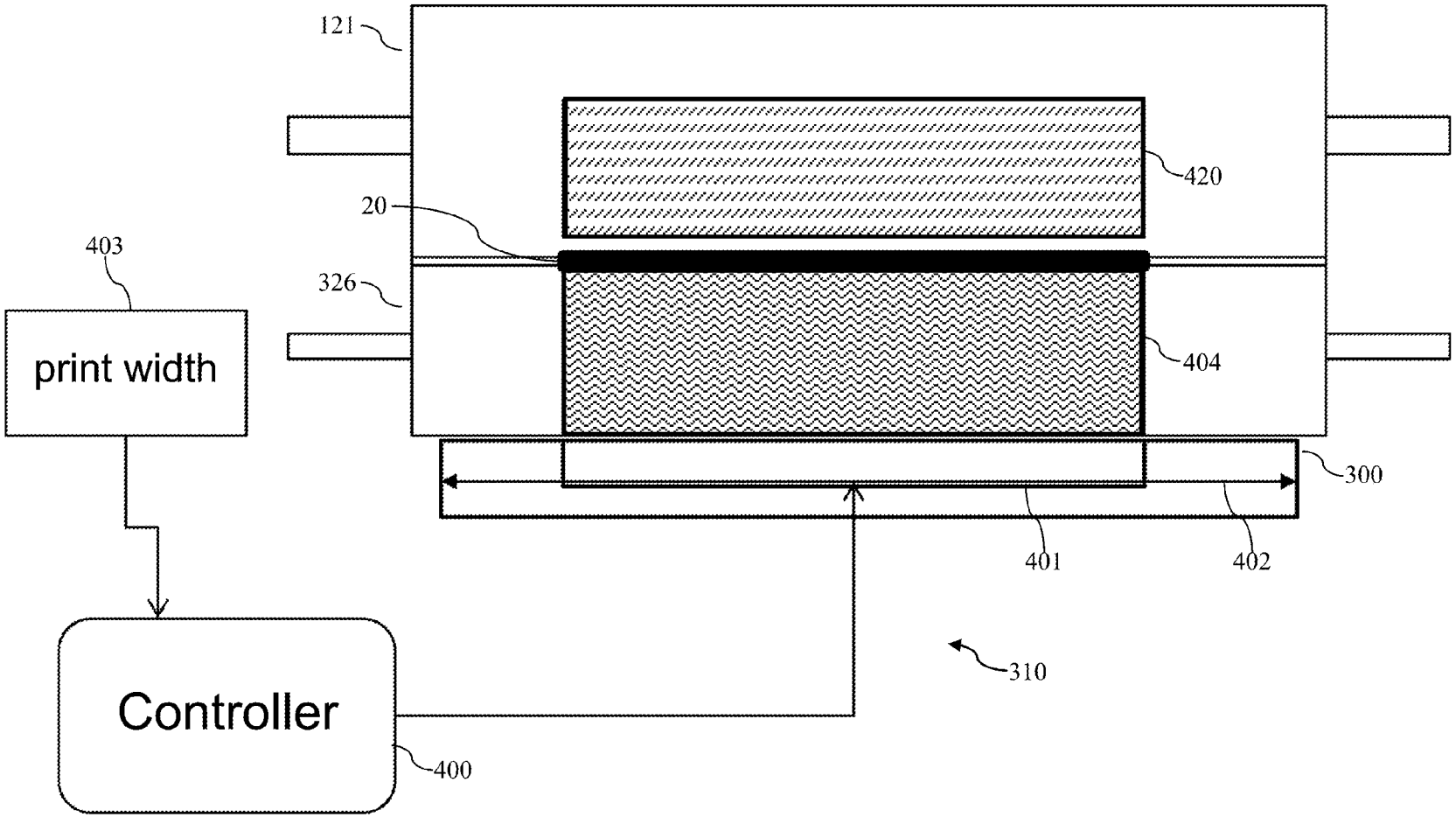
FIG. 4 shows an elevational view of the wetting system along a direction transverse to the axial direction of the counter-pressure roller according to an exemplary embodiment of the present disclosure.

FIG. 4 illustrates the wetting system 310 according to an exemplary embodiment of the present disclosure. The wetting system 310 can be configured to homogenize the contact resistance with, for example, the wetting device 300 that has a variable wetting width 402.

In an exemplary embodiment, the wetting system 310 includes a controller 400 configured to determine the print width 403 and adapt (or adjust) the wetting device 300 such that only a partial region 404 of the counter-pressure roller 326 is wetted. In an exemplary embodiment, the controller 400 is configured to control the wetting device 300 to wet a portion of the counter-pressure roller 326 based on the print width 403. In an exemplary embodiment, the controller 400 includes processor circuitry configured to perform one or more functions of the controller 400, including, for example, determining the print width 403 and adapting the wetting device 300.

In an exemplary embodiment, the wetting device can include a wetting member 401 adaptable (mechanically, for example) to the print width 403. It may thus be achieved that the contact resistance is reduced only in regions that are relevant to the toner image 420 and to the print image 20' that is created from this. The current flow may thus be increased via the nip that is relevant to the transfer process, without increasing a parasitic current flow in the substrate-free nip and/or in the nip that is irrelevant to the transfer process.

In an exemplary embodiment, the counter-pressure roller 326 may be configured such that the surface of the counter-pressure roller 326 is sufficiently conductive to enable a current flow across the nip that is relevant to the transfer process only when said counter-pressure roller 326 is in connection with the conductive fluid 301. On the other hand, the surface of the counter-pressure roller 326 may exhibit an increased resistance (for example may be substantially non-conductive) if the surface of the counter-pressure roller 326 has no conductive fluid. Parasitic currents in the nip that are irrelevant to the transfer process may thus be further reduced, whereby the quality of the toner transfer process is in turn increased.

In an exemplary embodiment, a raster roller may be configured such that the surface of the raster roller is sufficiently conductive only in connection with a conductive fluid in order to let current drain. This may take place via coating of a conductive roller blank with a non-conductive/low-conductivity layer. The non-conductive coating in the raster cups may be removed via the production of the raster roller structure. A non-conductive surface is thus created at the raster webs and a conductive surface is created in the raster cups. If the raster cups are now filled with the conductive fluid, the wetted surface 404 of the counter-pressure roller 326 is conductive. The conductivity difference between conductive and non-conductive points is hereby increased. In particular, it may thus be achieved that the conductivity of the counter-pressure roller 326 in the print image region 404 is markedly reduced relative to conductivity of the counter-pressure roller 326 in other regions.

Figure 5:
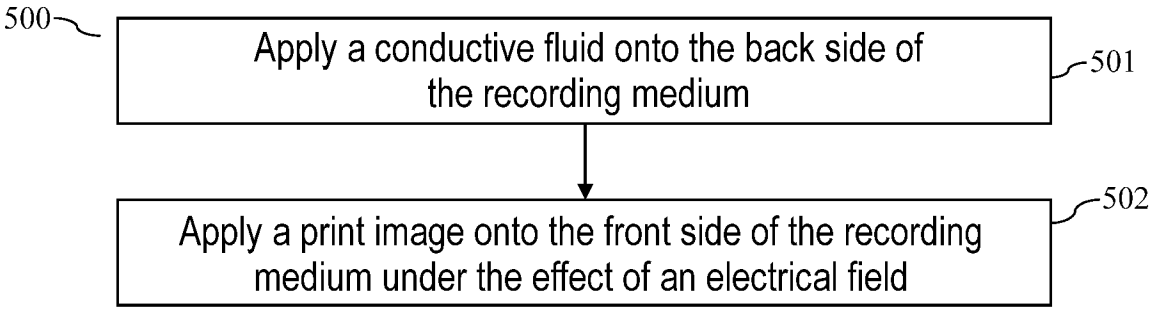
FIG. 5 shows a flowchart of a method for the homogenization of the electric contact resistance on a side of a recording medium according to an exemplary embodiment of the present disclosure.

FIG. 5 illustrates a flowchart of a method 500 according to an exemplary embodiment. The method 500 can improve the transfer of a toner image 420 onto a first side of a recording medium 20 in a digital printer 10, for example in an electrophotographic digital printer 10. In an exemplary embodiment, the digital printer 10 is configured to transfer a toner image 420 onto the recording medium 20 under the action of an electrical field. In an exemplary embodiment, the method 500 is designed to reduce the electrical contact resistance between a second side of the recording medium 20 and a counter-electrode (which, for example, is formed by the counter-pressure roller 126, 136 of the digital printer 10) of the digital printer 10, and/or to increase a degree of uniformity of the electrical contact resistance between the second side of the recording medium 20 and the counter-electrode. The degree of uniformity of the electrical contact resistance may, for example, be determined on the basis of a distribution of the electrical contact resistance along the width of the recording medium 20 (transversal to the transport direction 20") (for example on the basis of the variance and/or the spread of the electrical contact resistance along the width of the recording medium 20). This degree of uniformity may be increased via the method 500 (for example, the variance and/or the spread of the contact resistance may be reduced). This increase of the degree of uniformity may in particular take place in the region of the surface of the recording medium 20 that is relevant to the toner image 420.

In an exemplary embodiment, the digital printer 10 includes a transfer electrode that is arranged on the first side of the recording medium 20 and a counter-electrode that is arranged on the second side of the recording medium 20. In an exemplary embodiment, the transfer electrode may be formed by a transfer roller 121 and the counter-electrode may be formed by a counter-pressure roller 126, 326 of the digital printer 10, between which transfer electrode and counter-electrode the recording medium 20 is directed in order to transfer the toner image 420 from the transfer roller 121 onto the first side of the recording medium 20 at a transfer point.

In an exemplary embodiment, the method 500 includes the application 501 of a conductive fluid 301 onto the surface of the second side of the recording medium 20. The conductive fluid may be applied such that, at the transfer point, the conductive fluid 301 at least partially forms a conductive connecting layer between the surface of the second side of the recording medium 20 and a surface of the counter-electrode (e.g., the counter-pressure roller 126, 326). For example, for this purpose the counter-pressure roller 326 may be wetted with the conductive fluid so that, at the transfer point, the conductive fluid is transferred by the rotated counter-pressure roller 326 onto the surface of the second side of the recording medium 20. The use of the counter-pressure roller 326 for the application of the conductive fluid is particularly advantageous since a penetration of the conductive fluid into the inside of the recording medium 20 before reaching the transfer point may be avoided.

In an exemplary embodiment, the method 500 additionally includes the application 502 of the electrical field between the transfer electrode (e.g., the transfer roller 121) and the counter-electrode (in particular the counter-pressure roller 126, 326) at the transfer point in order to produce the transfer of the toner image 420 onto the first side of the recording medium 20. The contact resistance between the second side of the recording medium 20 and the surface of the counter-electrode is reduced and/or homogenized via the intermediate layer formed by the conductive fluid. This leads to an increase and/or homogenization of the electrical field at the nip on the first side of the recording medium 20, and thus to an increase and/or homogenization of the toner transfer from the transfer station 120 onto the recording medium 20.

In an exemplary embodiment, the print group 11, 12 for the digital printer 10 (in particular for a toner-based digital printer 10) is configured to perform the aforementioned method 500. In particular, the print group 11, 12 comprises a transfer station 120 that is configured to transfer a toner image 420 onto a first side of a recording medium 20 at a transfer point under the effect of an electrical field. Liquid toner and/or dry toner may thereby be used. For this purpose, the transfer station 120 is set up to apply the electrical field between a transfer electrode or a transfer element on the first side of the recording medium and a counter-electrode between a counter-pressure element on the second side of the recording medium 20. As was already presented above, the transfer electrode may be formed by a transfer roller 121 and the counter-electrode may be formed by a counter-pressure roller 126, 326.

In an exemplary embodiment, the print group 11, 12 includes a wetting system 310 that are configured to apply a conductive fluid 301 onto the surface of the second side of the recording medium 20 such that, at the transfer point, the conductive fluid 301 at least partially forms a conductive connecting layer between the surface of the second side of the recording medium 20 and the surface of the counter-electrode or of the counter-pressure element. In this example, a uniform and/or increased electrical field on the first side of the recording medium 20 may be produced via this conductive connecting layer on the second side of the recording medium 20, whereby the print quality is increased.

In an exemplary embodiment, the wetting system 310 can be configured to apply the conductive fluid 301 (directly or indirectly) onto the surface of the second side of the recording medium 20 at the transfer point. The region of the recording medium 20 at which the toner image 420 is transferred from the transfer element (for example from the transfer roller 121) onto the first side of the recording medium 20 may be designated as a transfer point. The transfer point can include a segment (e.g., bar-shaped segment) of the recording medium 20 at the nip between transfer roller 121 and counter-pressure roller 126, 326. By applying the conductive fluid 301 at the transfer point, a penetration of the conductive fluid 301 into the inside of the recording medium 20 before reaching the transfer point may be avoided and/or reduced. It may thus be ensured that the conductive connecting layer is formed by the conductive fluid 301 in the moment of the toner transfer.

In an exemplary embodiment, the application of the conductive fluid 301 directly at the transfer point may be achieved in that the conductive fluid is applied by the counter-pressure roller 126, 326 onto the surface of the second side of the recording medium 20.

In an exemplary embodiment, the counter-pressure roller 326 may include a plurality of raster cups via which the conductive fluid 301 may be brought to the surface of the second side of the recording medium 20. In other words, the counter-pressure roller 326 may be formed as a raster roller. Via the use of raster cups and/or via a suitable embodiment of the raster cups, it may be achieved that a quantity of conductive fluid 301 that is sufficient for the recording medium 20 is applied onto the second side of the recording medium 20. The number of raster cups and/or the shape of the raster cups may depend on a property of the recording medium 20. In other words, a scoop volume of the counter-pressure roller 326 may depend on a property of the recording medium 20. Examples of properties are, for example, a material of the recording medium 20, a thickness of the recording medium 20 and/or a degree of roughness of the second side of the recording medium 20. The degree of uniformity of the contact resistance between recording medium 20 and counter-pressure roller 326 may be additionally increased.

In an exemplary embodiment, the wetting system 310 is configured to apply the conductive fluid 301 onto the surface of the second side of the recording medium 20 based on a width 403 of the recording medium 20 and/or depending on a width 403 of the toner image 420. In an exemplary embodiment, the conductive fluid 301 may be applied exclusively in the region on the second side of the recording medium 20 that corresponds to the region of the first side of the recording medium 20 onto which the toner image 420 is transferred. No conductive fluid 301 is then applied onto the other regions of the recording medium 20. In an exemplary embodiment, no conductive fluid 301 is applied onto regions of the counter-pressure roller 126, 326 that do not come into contact with the second side of the recording medium 20. Parasitic currents between the transfer roller 121 and the counter-pressure roller 126, 326 that do not contribute to the toner transfer may thus be reduced. This is in turn advantageous for the strength of the electrical field which produces the toner transfer.

In an exemplary embodiment, the wetting system 310 may include a wetting device 300 that is configured to wet a surface of the counter-pressure roller 126, 326 with the conductive fluid before reaching the transfer point. In an exemplary embodiment, the wetting device 300 may include a chamber blade. In an exemplary embodiment, the wetting system 300 may be adjustable in order to wet regions 404 of the counter-pressure roller 126, 326 with the conductive fluid 301 according to differing wetting widths 402. In particular, the wetting width 402 may be adapted to the width 403 of the recording medium 20 and/or to the width 403 of the toner image 420.

In an exemplary embodiment, alternatively or additionally, a quantity of applied conductive fluid 301 or a thickness of an applied layer of conductive fluid 301 may be adapted. For example, the quantity of applied conductive fluid 301 may be adapted by the scoop volume of the raster cups of a raster roller and/or by the rotation speed of a raster roller.

In an exemplary embodiment, the counter-pressure roller 326 may be designed as a raster roller. Furthermore, the counter-pressure roller 326 may have a lower conductivity at a raster web between two raster cups than in a raster cup. In particular, the conductivity of the raster webs may be lower than the conductivity of the raster cups of the counter-pressure roller 326. The contact resistance of non-wetted regions (e.g., areas other than wetted portion 404) of the counter-pressure roller 326 may be additionally increased and parasitic currents may be further reduced. This leads to an additional increase of the print quality.

In one or more exemplary embodiments, the contacting between a counter-pressure roller 126, 326 and the second side of a recording medium 20 is improved and the volume resistance or the transversal resistance of the recording medium 20 is thus made more uniform. This is for toner transfer, given which toner is transferred from a transfer element onto the recording medium 20 under the effect of an electrical field, in particular for the toner transfer in a liquid toner printer or in a dry toner printer. Via wetting that is adjustable across the width 402, a resistance difference between a wetted region 404 and a non-wetted region at the counter-pressure roller 126, 326 may be increased. Parasitic currents may be reduced via the relatively increased resistance in the non-wetted region. Overall, the print quality of an electrophotographic digital printer 10 may thus be increased, in particular given the use of recording media 20 with a rough second side and/or with a relatively high thickness.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, processor circuitry can include one or more circuits, one or more processors, logic, or a combination thereof For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform conesponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the conesponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 digital printer
11, 11*a*-11*d* print group (front side or first side)
12, 12*a*-12*d* print group (back side or second side)
20 recording medium
20' print image (toner)
20" transport direction of the recording medium
21 roll (input)
22 take-off
23 conditioning group
24 turner
25 register
26 drawing group
27 take-up
28 roll (output)
30 fixer
40 climate control module
50 power supply
60 controller
70 fluid management
71 fluid controller
72 reservoir
100 electrophotography station
101 image substrate (photoconductor, photoconductor roller)
102 erasure light
103 cleaning device (photoconductor)
104 blade (photoconductor)
105 collection container (photoconductor)
106 charging device (corotron)
106' wire
106" shield
107 supply air channel (aeration)
108 exhaust air channel (ventilation)
109 character generator
110 developer station
111 developer roller
112 repository
112' fluid supply
113 pre-chamber
114 electrode segment
115 dosing roller (developer roller)
116 blade (dosing roller)
117 cleaning roller (developer roller)
118 blade (cleaning roller of the developer roller)
119 collection container (liquid developer)
119' fluid discharge
120 transfer station
121 transfer roller
122 cleaning unit (wet chamber)
123 cleaning brush (wet chamber)
123' cleaning fluid discharge
124 cleaning roller (wet chamber)
124' cleaning fluid discharge
125 blade
126 counter-pressure roller
127 cleaning unit (counter-pressure roller)
128 collection container (counter-pressure roller)
128' fluid discharge
129 charging unit (corotron at transfer roller)
300 wetting device
301 conductive fluid
302 container
310 wetting system
326 counter-pressure roller
400 controller
401 wetting member of the wetting system
402 wetting width
403 print width
404 wetting region of the counter-pressure roller
420 toner image
500 method to improve the print quality of a digital printer
501, 502 method steps

What is claimed is:

1. A print group for a digital printer, the print group comprising:

a transfer station configured to transfer a liquid toner image onto a first side of a web-shaped recording medium at a transfer point by an electrical field, the transfer station being configured to apply the electrical field between a transfer electrode on the first side of the web-shaped recording medium and a counter-electrode on a second side of the web-shaped recording medium, wherein the web-shaped recording medium is directed between the transfer electrode and the counter-electrode; and a wetting system configure to apply a conductive fluid onto a surface of the second side of the web-shaped recording medium at the transfer point, the conductive fluid at least partially forming a conductive connecting layer between the surface of the second side of the web-shaped recording medium and a surface of the counter-electrode at the transfer point.

2. The print group according to claim 1, wherein the wetting system is configured to apply the conductive fluid onto the surface of the second side of the web-shaped recording medium based on at least one of: a width of the web-shaped recording medium, and a width of the liquid toner image.

3. The print group according to claim 1, wherein:

the transfer station comprises a transfer roller and a counter-pressure roller between which the web-shaped recording medium is directed to transfer the liquid toner image from the transfer roller onto the first side of the web-shaped recording medium at the transfer point;

the electrical field is applied between the transfer roller on the first side of the web-shaped recording medium and the counter-pressure roller on the second side of the web-shaped recording medium; and the conductive fluid is applied by the counter-pressure roller onto the surface of the second side of the web-shaped recording medium.

4. The print group according to claim 3, wherein the counter-pressure roller comprises a plurality of raster cups configured to bring the conductive fluid to the surface of the second side of the web-shaped recording medium.

5. The print group according to claim 4, wherein the counter-pressure roller has a lower conductivity at a raster web between two raster cups of the plural of raster cups than in a raster cup of the plurality of raster cups.

6. The print group according to claim 3, wherein the wetting system comprises a wetting device that is configured to wet a surface of the counter-pressure roller with the conductive fluid before the surface of the counter-pressure roller reaches the transfer point.

7. The print group according to claim 6, wherein the wetting device comprises a chamber blade.

8. The print group according to claim 6, wherein the wetting device is adjustable such that the wetting device is configured to wet a region of the counter-pressure roller with the conductive fluid with a differing wetting width.

9. The print group according to claim 1, wherein the wetting system comprises:

a wetting device that is configured to apply the conductive fluid onto the surface of the second side of the web-shaped recording medium at the transfer point via a counter-pressure roller of the transfer station that is positioned on the second side of the recoding medium; and a controller configured to control the wetting device to adjust an amount of the conductive fluid applied onto the surface of the second side of the web-shaped recording medium.

10. The print group according to claim 9, wherein the controller is configured to:

determine at least one of: a width of the web-shaped recording medium and a width of the liquid toner image; and adjust the amount of the conductive fluid applied based on the determined at least one of the width of the web-shaped recording medium and the width of the liquid toner image.

11. The print group according to claim 1, wherein:

the transfer station comprises a transfer roller and a counter-pressure roller between which the web-shaped recording medium is directed to transfer the liquid toner image from the transfer roller onto the first side of the web-shaped recording medium at the transfer point; and the counter-pressure roller comprises a plurality of raster cups configured to bring the conductive fluid to the surface of the second side of the web-shaped recording medium.

12. The print group according to claim 1, wherein:

the transfer station comprises a counter-pressure roller that is positioned on the second side of the recoding medium; and the controller is configured to:

determine at least one of: a width of the web-shaped recording medium and a width of the liquid toner image; and adjust the amount of the conductive fluid applied based on the determined at least one of the width of the web-shaped recording medium and the width of the liquid toner image.

13. A method to improve a transfer of a liquid toner image onto a first side of a web-shaped recording medium in a digital printer having a transfer electrode and a counter-electrode between which the web-shaped recording medium is directed to transfer the liquid toner image onto the first side of the web-shaped recording medium at a transfer point, the method comprising:

applying a conductive fluid onto a surface of a second side of the web-shaped recording medium such that, at the transfer point, the conductive fluid at least partially forms a conductive connecting layer between the surface of the second side of the web-shaped recording medium and a surface of the counter-electrode, wherein the conductive fluid is applied onto the surface of the second side of the web-shaped recording medium at the transfer point; and applying an electrical field between the transfer electrode and the counter-electrode at the transfer point to produce the transfer from the liquid toner image onto the first side of the web-shaped recording medium.

14. A non-transitory computer-readable storage medium with an executable program stored thereon, wherein the program instructs a processor to perform the method of claim 13.

15. The method of claim 13, wherein:

the counter-electrode is a counter-pressure roller that comprises a plurality of raster cups configured to bring the conductive fluid to the surface of the second side of the web-shaped recording medium to apply the conductive fluid onto the surface of the second side of the web-shaped recording medium.

16. A print group for a digital printer, the print group comprising:

a transfer station having a transfer electrode and a counter electrode, the transfer station being configured allow a web-shaped recording medium to pass between the transfer electrode and the counter electrode and to transfer a liquid toner image onto a first side of a web-shaped recording medium via the transfer electrode at a transfer point; and a wetting system that includes:

a wetting device configured to apply a conductive fluid having a wetting width onto a surface of the second side of the web-shaped recording medium at the transfer point; and a controller configured to:

determine at least one of a width of the web-shaped recording medium and a width of the liquid toner image; and adjust the wetting width based on the determined at least one of the width of the web-shaped recording medium and the width of the liquid toner image.

17. The print group according to claim 16, wherein the wetting device is positioned adjacent to the counter electrode and configured to apply the conductive fluid onto a surface of the counter electrode, wherein the counter electrode transfers the applied conductive fluid onto the second side of the web-shaped recording medium at the transfer point.

18. The print group according to claim 17, wherein the counter electrode is movable such that the surface of the counter electrode travels from a first position adjacent to the wetting device to a second position adjacent to the transfer point, wherein the wetting device is configured to apply the conductive fluid onto the surface of the counter electrode at the first position.

19. The print group of claim 16, wherein:

the counter-electrode is a counter-pressure roller comprising a plurality of raster cups; and the wetting device is configured to apply the conductive fluid onto the counter-pressure roller, the plurality of raster cups being configured to bring the conductive fluid to the surface of the second side of the web-shaped recording medium to apply the conductive fluid onto the surface of the second side of the web-shaped recording medium at the transfer point.

* * * * *